US006269497B1

(12) United States Patent
Renfro

(10) Patent No.: US 6,269,497 B1
(45) Date of Patent: Aug. 7, 2001

(54) WATERBED MATTRESS SYSTEM FOR RECREATIONAL VEHICLES

(75) Inventor: William L. Renfro, 1431 33rd St. NW., Washington, DC (US) 20007

(73) Assignee: William L. Renfro, Washington, DC (US)

( * ) Notice: Subject to any disclaimer, the term of this patent is extended or adjusted under 35 U.S.C. 154(b) by 0 days.

(21) Appl. No.: 09/257,939

(22) Filed: Feb. 26, 1999

Related U.S. Application Data

(63) Continuation-in-part of application No. 09/110,021, filed on Jul. 2, 1998, now Pat. No. 6,094,758.

(51) Int. Cl.[7] ..... B60P 3/38
(52) U.S. Cl. ..... 5/118; 5/422; 5/672
(58) Field of Search ..... 5/118, 422, 671, 5/672, 683, 686

(56) References Cited

U.S. PATENT DOCUMENTS

| | | | | |
|---|---|---|---|---|
| 1,212,479 | | 1/1917 | Hall . | |
| 3,456,270 | | 7/1969 | Weinstein et al. . | |
| 3,585,356 | | 6/1971 | Hall . | |
| 3,707,735 | * | 1/1973 | Carson, Jr. | 5/671 |
| 3,760,147 | | 9/1973 | Tyrey . | |
| 3,772,717 | | 11/1973 | Yuen et al. . | |
| 3,879,698 | | 4/1975 | Darling . | |
| 4,057,862 | | 11/1977 | LaBianco . | |
| 4,109,333 | | 8/1978 | Zmiarovich . | |
| 4,114,215 | * | 9/1978 | Santo | 5/422 X |
| 4,422,194 | | 12/1983 | Viesturs et al. . | |
| 4,521,929 | | 6/1985 | Keefer . | |
| 4,627,121 | | 12/1986 | Winther . | |
| 4,707,872 | | 11/1987 | Hessel . | |
| 4,708,084 | | 11/1987 | Campau . | |
| 4,736,478 | | 4/1988 | Dangerously . | |
| 4,737,998 | | 4/1988 | Johnson, Sr. . | |
| 4,947,500 | | 8/1990 | Seiler . | |
| 4,974,272 | * | 12/1990 | Liu | 5/422 |
| 5,005,238 | | 4/1991 | Freet . | |
| 5,203,808 | * | 4/1993 | Ide | 5/672 |
| 5,309,585 | * | 5/1994 | Hochschild, III | 5/672 |
| 5,617,811 | | 4/1997 | Johnson . | |
| 5,850,644 | * | 12/1998 | Hsia | 5/422 |
| 5,966,755 | * | 10/1999 | Pittman | 5/118 |
| 6,094,758 | * | 8/2000 | Renfro | 5/118 |

FOREIGN PATENT DOCUMENTS 5-277021 10/1993 (JP) .

OTHER PUBLICATIONS

Article entitled "Waterbeds on Wheels", Waterbed Magazine, Feb. 1986, p. 28.*

* cited by examiner

*Primary Examiner*—Michael F. Trettel
(74) *Attorney, Agent, or Firm*—Fisher, Christen & Sabol

(57) ABSTRACT

A waterbed mattress system for recreational vehicles and, in particular, to a waterbed system for a recreational vehicle having a cabin or sleeping area or space or flat or truck bed which includes a waterbed mattress which can be filled from a source of water internal or external to the vehicle through the side, wall or floor of the vehicle via a series of tubes and a pump.

18 Claims, 3 Drawing Sheets

WATERBED MATTRESS SYSTEM FOR RECREATIONAL VEHICLES

This is a continuation-in-part of U.S. Ser. No. 09/110,021, filed on Jul. 2, 1998 now U.S. Pat. No. 6,094,758.

BACKGROUND OF THE INVENTION

Field of the Invention

The invention relates to a waterbed and water mattress system for recreational vehicles and, in particular, to a waterbed system for a recreational vehicle preferably having a cabin or sleeping area, which includes a waterbed mattress and means for transporting water or other liquid to and into the waterbed mattress from an internal or external water or other liquid source.

BROAD DESCRIPTION OF THE INVENTION

An object of the invention is to achieve the advantages of a waterbed mattress in providing cool sleeping accommodations in a warm climate without an air conditioning system or warm sleeping accommodations in a cold climate while overcoming the disadvantages and problems of using permanently installed waterbeds and water mattresses in recreational vehicles. For example, prior to this invention, to have cool sleeping accommodations in warm climates, recreational vehicles required expensive, noisy, vibrating air conditioning unit(s) and generator(s) to power them. The utility of recreational vehicles without cool sleeping accommodations is severely limited in the warmest months. If one were to use a waterbed or a water mattress in a recreational vehicle, the water filled bed or mattress would be too heavy to transport without major structural and performance questions, including, among others, stability, economy, stopping, acceleration, handling, safety issues. Also, unless one would employ , water before moving the vehicle, the water filled mattress would also take up valuable space in the vehicle. In contrast, the waterbed and water mattress system of the instant invention can be emptied each morning and re-filled after one has traveled to one's new destination, or at the same campground or camping area. Also, without the weight of the water in the waterbed mattress, a recreational vehicle retains its original handling characteristics, stability and inherent safety features. Both self-propelled and towed recreational vehicles can achieve greater travel speed than with a filled waterbed mattress. Also, a recreational vehicle with a drained waterbed can achieve greater fuel efficiency while traveling somewhere.

Other objects and advantages of the invention are set out herein or are obvious therefrom to one skilled in the art.

The objects and advantages of the invention are achieved by the waterbed and water mattress system of the invention.

A waterbed is a mattress-shaped bag filled with water and placed on a bedframe or bunk, for making the surface conform to the user's or the sleeper's body in any position.

The invention waterbed mattress system includes a waterbed mattress (preferably having an upper layer, a lower layer and an inner layer and numerous longitudinal and transverse vertical layers creating many small cells or compartments, which each have at least several and, preferably, numerous holes in them) and means for transporting water or another liquid to and into the waterbed mattress from a source of water external to the vehicle, or from a water supply internal to the vehicle from a source so located as to minimize the effects of the water on the stability and handling of the vehicle. This water transportation means can be also used for transporting the water or other liquid from the waterbed mattress to the outside of the vehicle or back to its internal source. The waterbed mattress system can also include separate means for heating the water or other liquid being transported to and into the waterbed mattress from the internal or external supply. The waterbed mattress system can also include separate means for transporting the water from the waterbed mattress to the internal or external supply. The various valves used in the waterbed mattress system can be operated manually or automatically, preferably automatically by electronic remote control systems.

The various pumps used in the waterbed mattress system can be manual, mechanical or gravity powered, preferably with automatic pressure shut-off systems.

As used herein, the term "tubes" includes pipes, hoses and other similar hollow conduits through which water or other liquid can flow. Preferably, the fixed tubes are made of materials, such as, stainless steel, bronze or rigid quality plastic. The tubes connected to the waterbed mattress are of a flexible material, preferably a high quality flexible plastic or rubber.

If the vehicle is of sufficient size, two or more waterbeds or mattresses can be present, in which case the water inlet and outlet systems preferably are branched so as to be parallel to one another, are entirely different systems or are a hybrid of a parallel/series arrangement.

The waterbed mattress can be used alone or on a bedstead or other bed frame. Also, the waterbed mattress(es) can be used in a bunk bed(s).

As used herein, the term vehicle(s) includes powered and unpowered mobile land vehicles. The vehicle containing a water mattress or bed can be propelled or towed by, for example, any power source (for example, by a diesel or a gasoline engine, electric motor or other source of movement). The invention waterbed mattress system is particularly useful in self-propelled recreational vehicles, personalized vans, pickups with camper bodies, civilian, military or commercial trucks and buses, station-wagons, trailers, campers, etc. That is, the invention waterbed mattress system is useful in either pleasure recreational vehicles, commercial recreational vehicles or military recreational vehicles.

The structure of the vehicle can be made of any suitable material such as fiberglass, steel, aluminum, wood, alloys and/or composite materials, etc.

The invention also includes a combination of a recreational vehicle with the invention waterbed mattress system.

Modifications and changes made to the waterbed mattress system can be effected without departing from the scope or spirit of the present invention. For example, whereas the waterbed probably usually will be used in a cabin or sleeping space of a recreational vehicle, it can be used on a trailer, flatbed, pickup truck bed, or other space available in or on a vehicle.

DETAILED DESCRIPTION OF THE INVENTION

The invention waterbed mattress system includes a waterbed mattress and means for transporting water or other liquid to and into the waterbed mattress from a body of water external to the vehicle or a water (or other liquid) supply (not shown) internal or external to the vehicle.

Figure 1:
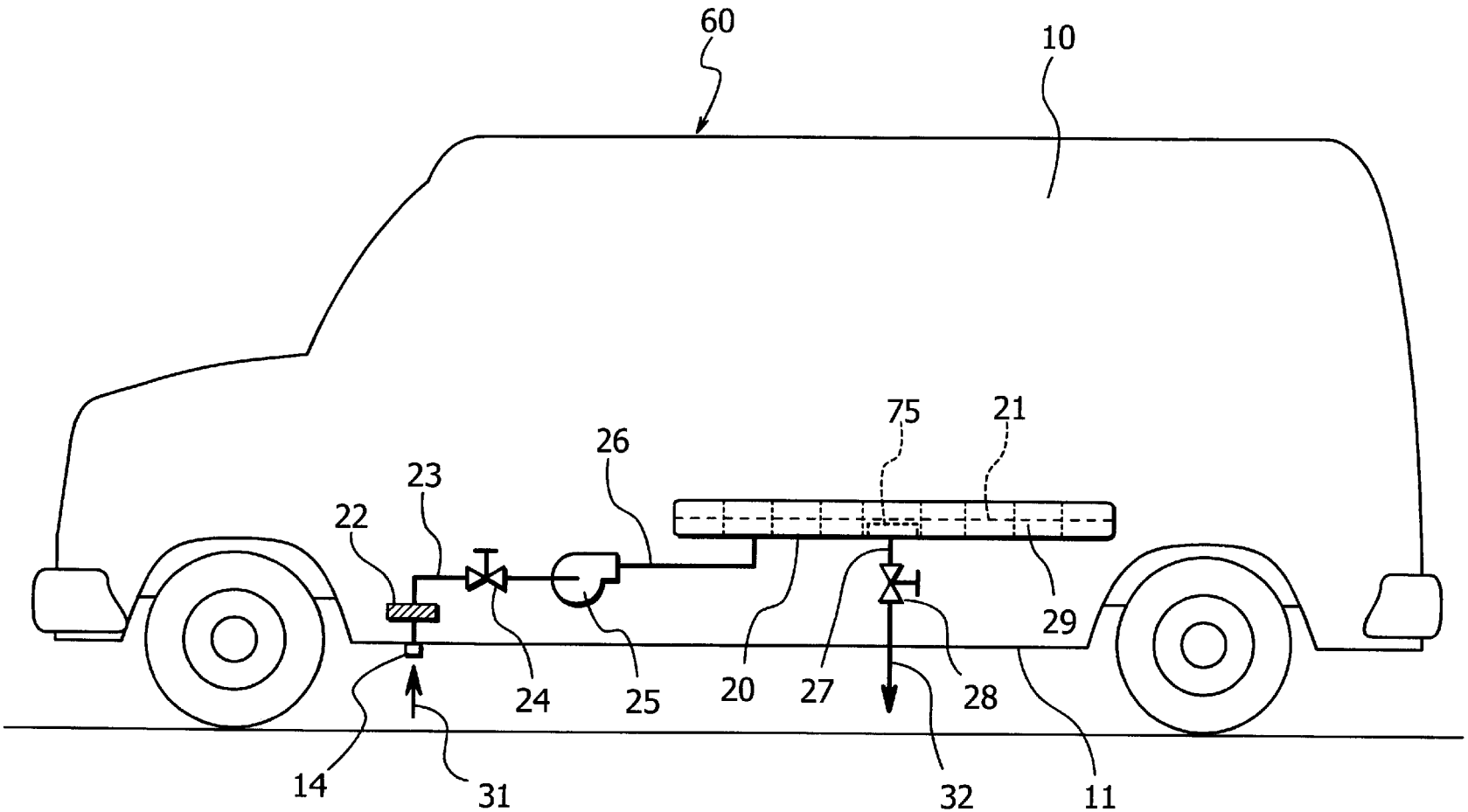
FIG. 1 is a side view of a recreational vehicle having a cabin or sleeping area or space or flat bed or truck bed and in which is housed a waterbed mattress.
Figure 2:
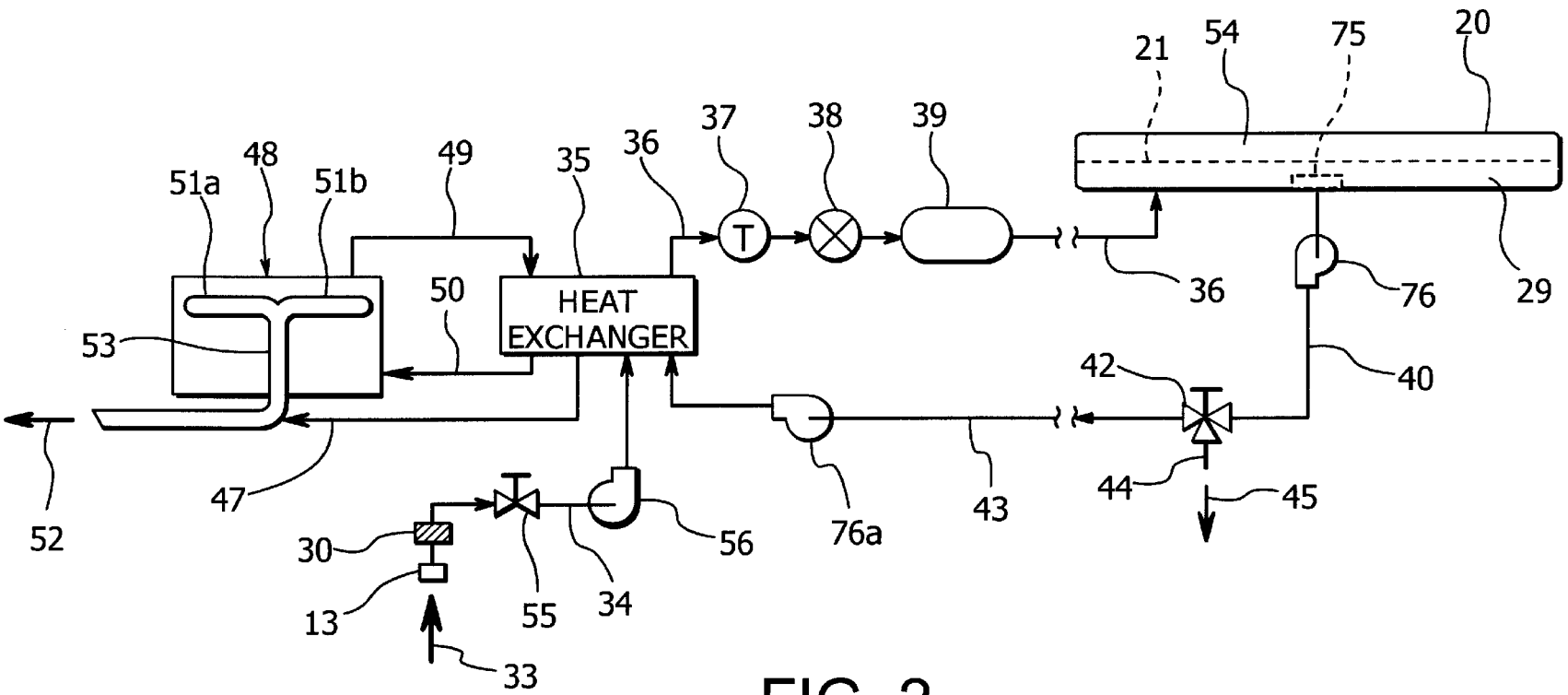
FIG. 2 is a side view of the water bed mattress system when it includes one waterbed mattress and means for transporting water to and into the waterbed mattress from a source of water internal or external to the vehicle, means for heating the water being transported to and into the waterbed mattress from the source of water internal or external to the vehicle, and means for transporting the water from the waterbed mattress to and into the source of water internal or external to the vehicle.
Figure 3:
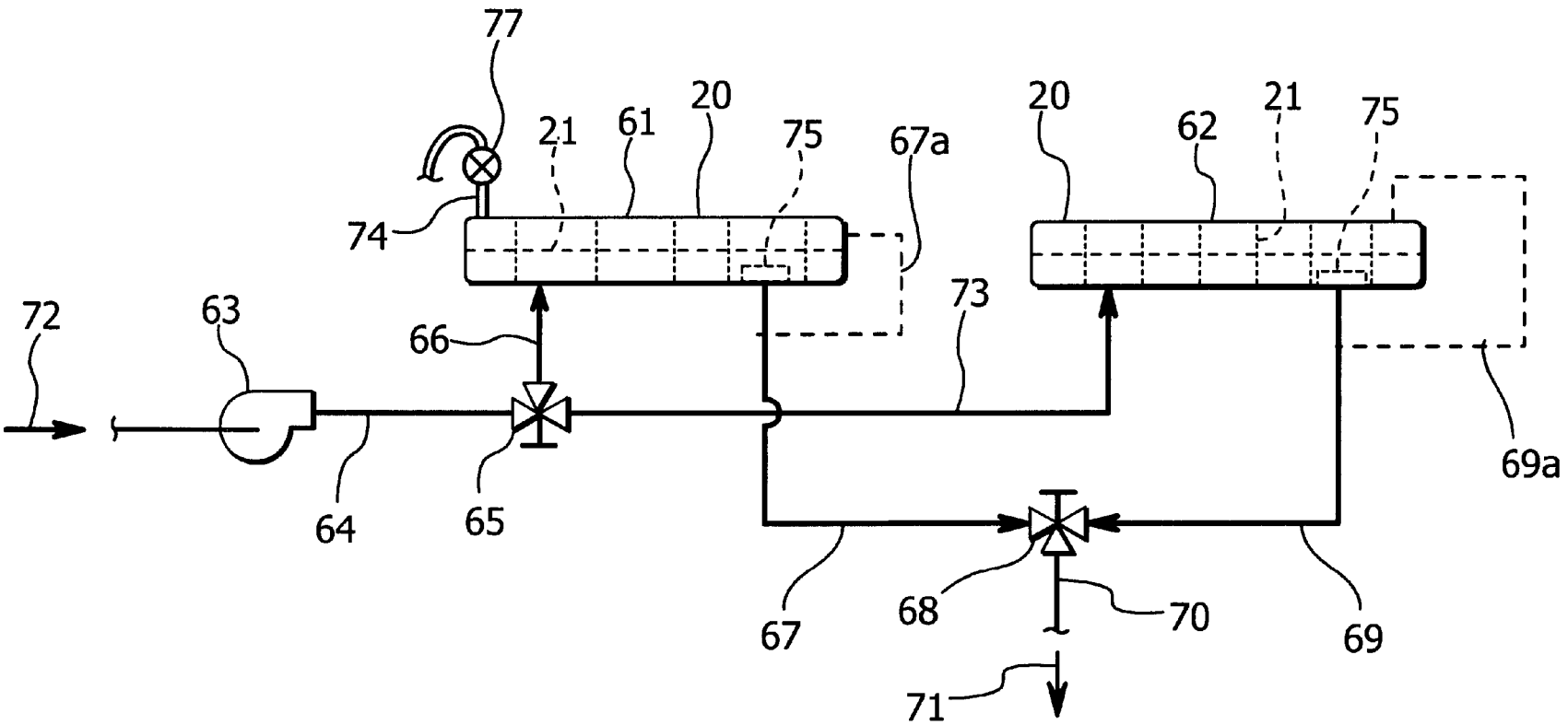
FIG. 3 is a side view of the waterbed mattress system when it includes at least two waterbed mattresses.

As is shown in FIG. 1, FIG. 2 and FIG. 3, the waterbed mattress (20) includes an upper level (54), a lower level (29) and an inner layer (21). The waterbed mattress may be either above or at or the floor level (11) of the vehicle (60). The inner layer (21) has numerous holes in it, so that the water may flow freely into the waterbed mattress and from the waterbed mattress. Also, in a time-delayed manner, water may flow freely between the upper and lower, fore, aft, longitudinal and transverse layers, cells or compartments of the mattress. Because of this time impeded flow through the inner layer, cells or compartments (21), when one lays on the mattress the water adjustment in the mattress to the body shape is slowed, but not prevented. Also, if the angle of the vehicle and, hence, the waterbed mattress changes, sloshing is reduced, slowed or eliminated. The waterbed mattress (20) and internal layers, cells or compartments (21) can be made of any suitable material, such as, a vinyl or rubber material.

As shown in FIG. 1, the means for transporting water or liquid to and into the waterbed mattress (20) from a source of water (31) external to the vehicle or an internal supply such as a water tank, can include a female or male fitting (14) for connection to a hose conducting water (31) from an external source, a filter or strainer (22), a first valve (one-way) (24), a pump (25), which may be motor driven, manual or gravity fed, a first tube (23) [which runs both between the filter or strainer (22) and the first valve (24) and between the first valve (24) and the pump (25)], a second tube (26) [which runs between the pump (25) and the waterbed mattress (20)], a second valve (one-way) (28), and a third tube (27) [which runs both between the waterbed mattress (20) and the second valve (28) and between the second valve (28) and the source of water internal or external to the vehicle (or to the ground holding means)].

The outer surface of the filter or strainer (22) preferably is flush with the outer surface of the body (60) of the vehicle (10) with nozzle (14) external totally or in part to the outer surface of vehicle body (60). The filter or strainer (22) prevents particulate matter larger than the holes in the filter or strainer (22) from entering the waterbed mattress system. The outer surface of third tube (27) can be shaped to provide a siphon-like action, facilitating exit of water (32) from the waterbed mattress (20) and the vehicle (60).

The first (one-way) valve (24) allows water to flow forward to the pump (25). Each of the valves used in the invention, including first valve (24) can be operated either manually or automatically, preferably automatically, by an electronic remote control system. The external source of water (31) can be under pressure, such as, a community water system, well water moved by means of a pump, etc.

The pump (25) allows one to control the speed of the flow of the water through the various tubes into the waterbed. Any suitable pumping device can be used, preferably one with an automatic pressure control switch. Care must be taken so as not to allow the water pressure in the mattress (20) to become too great [e.g., rupture the mattress (20)].

A means to automatically avoid the problem of overpressure and the potential for water-bed mattress rupture, as shown in FIG. 3, is an overflow pipe (74) with a one way valve (77) allowing overflow from a full waterbed mattress. The height of the overflow pipe (74) limits the maximum water pressure in the waterbed mattress; an alternative is an adjustable pressure relief check valve (not shown).

Another means to automatically avoid the problem of overpressure is, as shown in FIG. 3, to use a flow control meter (38) set to shut-off after allowing a pre-set volume of water or other liquid to be transported to an into the waterbed mattress. A pressure control or limiting valve may be used for valve (38). Also, all pressure control means can be used in concert together.

The end of the third tube (27) preferably is flush with the outer surface of the vehicle (60).

The second (one-way) valve (28) allows water to flow by gravitational force from the lower level of the waterbed mattress (20) onto the ground or a drain or body of water (11) near the vehicle or other internal or external source.

The waterbed mattress (20) in FIG. 1 can be located higher in the cabin of the vehicle, in a flatbed or on other flat surface (10). If the waterbed mattress (20) in FIG. 1 is below the water source (11), then the pump (25) is not needed and a pump (not shown) is needed in the line (27). If the waterbed mattress (20) is at the level of the water source, both intake and outflow pumps may be used to facilitate use of the waterbed mattress. As shown in FIG. 2, the water (45) exiting the waterbed mattress and vehicle can alternatively be passed back through tube (34) and filter (30), providing a back flush or cleaning function of filter (30), preventing clogging.

In FIG. 1, the vehicle (60) is shown parked near a water source (31). The water source can be, for example, a body of water, such as, a lake, river, estuary, bay, sea, ocean or the like, a water tank, a water well, a city or urban or other pressurized water pipe system, etc. The body (10) of the vehicle (60) can be made of any suitable material, such as, fiberglass, steel, aluminium, wood, alloys and/or composite materials.

As shown in FIG. 2, a means for heating the water or other liquid being transported to and into the waterbed mattress from the source of water (33) internal or external to the vehicle, can include a heat exchanger (35), a temperature gauge (37), a check valve, flow-control/limiter or pressure control/limiter valve (38), a pressure expansion tank (39), a fifth tube (36) [extending from the heat exchanger (35), to a temperature gauge for manual temperature control via valve (55) or automatic temperature control via a thermostat (37) or a digital or other adjustable automatic temperature control device, to the check valve (38), to the pressure expansion tank (39), to the waterbed mattress (54) via a tube (36) which is of a flexible material in the portion which attaches to the waterbed mattress], a fourth (two-way) valve (42), a sixth tube (40) the portion of which is attached to the waterbed mattress of a flexible material, [running between the waterbed mattress (20) and the fourth valve (42)], a seventh tube (43) [extending between the fourth valve (42) and the heat exchanger (35)], a nozzle fitting (13), a strainer or filter (30), a third valve (one-way) (55), a pump (56), a fourth tube (34) [running both between the strainer or filter and the third valve (55), and between the third valve (55) and the heat exchanger (35)], an engine or generator (48), a manifold (53) [extending from the engine or generator to the source of water internal or external to the vehicle (11), an eighth tube (47) [running from the heat exchanger (35) to the portion of the manifold or exhaust pipe (53) extending from the engine or generator (48), via two exhaust manifolds (51 and 51*b*)], and a water cycling system (49 and 50). Another means for heating water transported to the waterbed mattress is a solar heater or heater using fuel of any sort (both not shown) in lieu of heat exchanger (35).

The pressure expansion tank (39) can then be used to control the pressure in the mattress (20). The fourth valve (42) is a two-way valve. Through this valve (42), water can flow from the waterbed mattress (29) either to the source of water internal or external to the vehicle (11) (or to the ground) or can be recycled by means of the small pump (75) via the heat exchanger (35) into the mattress (20) to maintain the temperature of the waterbed mattress. Valve (42), recycling pump (75), pump (56), automatic temperature control via thermostat (37), valve (55) and pressure control device (38) can all be connected to a remote automatic control system.

The pump (56) can be used to control the speed of the flow of water from the external source of water (33) through the filter or strainer (30) and into the heat exchanger (35). A third (one-way) valve (55) can also be present on the fourth tube (34) to control the flow of water from the source of water internal or external to the vehicle into and from the heat exchanger (35).

A vehicle engine or generator cooling system (49 and 50) includes a ninth tube (49) running from the engine or generator or other heat source (48) to the heat exchanger (35) and a tenth tube (50) running from the heat exchanger (35) to the engine or generator (48). Water from the inlet water (34 and 36) can be inserted via the tube (47) into the exhaust manifold (53) to reduce pollutant particles in the exhaust fumes (52) exiting the exhaust manifold (53).

An alternative for an engine or generator which is cooled by passing water from outside of the vehicle through the engine or generator (48) without a heat exchanger, is to use the water exiting from the engine or generator (48) to blend with the intake water in pipe (36) while maintaining sufficient flow via pipe (47) to provide exhaust manifold and exhaust pipe cooling, if present on engine or generator (48).

The temperature of the water in the waterbed mattress (20) can be kept at any suitable temperature, but it is usually kept at 92° to 96° F. when warmth is sought by the user or at 88° to 92° F. for cool sleeping or lower, if the user seeks to quickly cool down.

To maintain (or raise) a particular water temperature (range) in the waterbed mattress (20), water can be recycled using either drain/recycle pump (76) or recycle pump (76*a*) through the heat exchanger (35) as needed via the recycle line (see FIG. 2) to ply heated water to the mattress (20).

The strainer (75) is located on portion (29) of the water bed mattress (20) at the entrance to the exit tube (27). Exit tube (27) can be located on the lower, side or upper part of the water-bed mattress so as not to interfere with comfortable use of the waterbed mattress (67*a* and 69*a*) and still provide a secure connection protected from chaffing or abrasion. Additional safety valves (not shown) may be located as close as practical to waterbed mattress (20) and all other waterbed mattresses (61 and 62) in tubes connected to waterbed mattress to prevent unplanned or accidental discharge or draining of water or other liquid from waterbed mattress through any failure in the tubes, pumps, valves or connections. The purpose of the strainer (75) is to prevent the mattress (20) from collapsing [and blocking the top exit hole of tube (27)] due to too rapid exit of water or other liquid from the mattress (20). The strainer (75) is preferably about 3 to 2 inch thick. The strainer (75) is composed of fibers, preferably soft, highly porous, flexible fiberglass, so as to allow the rapid exit flow of exiting water.

The engine or generator (48) can be, for example, an internal or external combustion and other cannot cycle engine, mounted inboard or outboard, using gasoline, diesel fuel or any other fuel which generates heat. The engine or generator can be a solar heater, an electric resistance heater or a heater using any fuel that produces heat. For internal and external combustion liquid-cooled engines and generators on pleasure and commercial recreational vehicles, filter (30), valve (55), pipe (34) and pump (56) are usually present so that pipe (36) can be a branch of heat exchanger exit pipe (47). When 48 is an engine as opposed to a generator, it drives a shaft (not shown in the figures).

An electrical resistance heater (or other types of heater) can be installed in the water in-take line (or water recycle line) or under or around the waterbed mattress to heat the water to be used in the waterbed when, for example, the vehicle is parked where engine heating is generally not used, desired or, in the case of winterized engine(s) or generator (s), not available.

FIG. 3 shows including at least two waterbed mattresses as part of the waterbed mattress system. The waterbed mattress system shown in FIG. 3 includes two waterbed mattresses (61 and 62), a two-way sixth valve (68), a fourteenth tube (69) [running between the sixth valve (68) and one of the mattresses (62)], a thirteenth tube (67) [running between the sixth valve (68) and another mattress (61)], a pump (63), a two-way fifth valve (65), an eleventh tube (64) [running both between the water source and the pump (63), and between the pump (63) and the fifth valve (65)], a sixteenth tube (73) [extending from the fifth valve (65) to one of the mattresses (62)], a twelfth tube (66) [extending from the fifth valve (65) to another mattress (61)], and a fifteenth tube (70) [extending from the sixth valve (68) to the ground or water source external or internal to the vehicle].

The pump (63) controls the flow of the water from the source of water (72) internal or external to the vehicle (10) into one of the two mattresses (61 and 62), depending upon which direction the fifth valve (65) is channeling the water, that is, depending upon whether the valve (65) is open in the direction of mattress (61) or mattress (62).

A shaking or pulsing device or means (not shown) can be mounted in conjunction with the waterbed mattress to provide a message-like, therapeutic, relaxing or stimulating sensation.

All of U.S. Ser. No. 09/110,021, filed on Jul. 2, 1998, is incorporated herein by reference. U.S. Ser. No. 09/110,021 discloses a waterbed and water mattress system for boats and, in particular, to a waterbed system for a boat preferably having a cabin above and/or below a deck, which includes a waterbed mattress and means from transporting water or other liquid to and into the waterbed mattress from a body of water surrounding the boat or from an internal or external water or other liquid source.

LIST OF PARTS NUMBERS

In connection with the figures, the following list of the names of the parts of the instant invention are noted:

10 body of the vehicle;
11 floor of the vehicle;
13 fitting;
14 fitting;
20 first waterbed mattress;
21 horizontal, vertical, longitudinal and transverse porous inner layers, cells or compartments of first waterbed mattress;
22 filter or strainer;
23 first tube (running both between the filter or the strainer and the first valve and between the first valve and the pump);
24 first valve (one-way);
25 pump;
26 second tube (running between pump and waterbed mattress);
27 third tube (running both between waterbed mattress and second valve and between second valve and a body of water, to the ground or to the internal or external liquid supply);
28 second valve (one-way);
29 lower level of first waterbed mattress;
30 filter or strainer;
31 water or other liquid from a body or water or internal or external supply of liquid entering the filter or strainer;
32 water or other liquid exiting the second (one-way) valve and flowing into body of water, to the ground or to the internal or external supply;
33 water or other liquid from a body of water or to the internal or external supply entering the filter or strainer;
34 fourth tube (running both between the strainer or filter and the third valve, and between the third valve and the heat exchanger);
35 heat exchanger;
36 fifth tube (running from the heat exchanger, to the temperature gauge, to the check valve, to the pressure expansion tank, to the waterbed mattress);
37 temperature gauge or thermostat;
38 check valve, flow meter/monitor with shut-off control, or pressure limiting valve;
39 pressure expansion tank;
40 sixth tube (running between the waterbed mattress and the fourth valve);
42 fourth valve (two-way);
43 seventh tube (running between the fourth valve and the heat exchanger);
44 water or other liquid entering the fourth valve from the waterbed mattress;
45 water or other liquid exiting the fourth valve and flowing into a body of water, to the ground or to the internal or external supply;
47 eighth line (running from the heat exchanger to the exhaust manifold or exhaust pipe);
48 engine, or generator or other heat source;
49 ninth tube (water or other liquid cycling line running from the engine or generator to the heat exchanger);
50 tenth tube (water or other liquid cycling line running from the heat exchanger to the engine or generator);
51*a* first exhaust manifold;
51*b* second exhaust manifold;
52 exhaust fumes exiting from the manifold;
53 exhaust pipe;
54 upper level of first waterbed mattress;
55 third valve (one-way);
56 pump (manual or motor driven);
60 the vehicle;
61 second waterbed mattress;
62 third waterbed mattress;
63 pump (manual or motor driven);
64 eleventh tube (running both between the water source and the pump, and between the pump and the fifth valve);
65 fifth valve (two-way);
66 twelfth tube (running from the fifth valve to the second waterbed mattress);
67 thirteenth tube (running from the second waterbed mattress to the sixth valve;
67*a* alternative water exit connection point;
68 sixth valve (two-way);
69 fourteenth tube (running between the sixth valve and the third waterbed mattress);
69*a* alternative water exit connection point;
70 fifteenth tube (running between the sixth valve and a body of water, to the ground or to the internal or external supply);
71 water or other liquid exiting the fourteenth line and flowing into a body of water, to the ground or to the external or internal source;
72 water or other liquid entering from a body of water or an internal or external supply into the tenth line running between the pump and fifth valve;
73 a sixteenth tube (extending from the fifth valve to one of the two waterbed mattresses);
74 overflow (anti-rupture) pipe;
75 fiberglass strainer;
76 drain/recycle pump;
76*a* recycle pump;
77 check valve.

What is claimed is:

1. A waterbed mattress system comprising:

(a) a wheeled recreational vehicle;

(b) a waterbed mattress large enough for a person to lay prone upon; and (c) means for the ingress or egress of a liquid, which is water or another aqueous liquid, to and into or out of the waterbed mattress from a supply of the liquid selected from the group consisting of (i) a source external to the vehicle and (ii) a source internal to the vehicle.

2. The waterbed mattress system for the recreational vehicle according to claim 1 wherein the means for ingress or egress of the liquid is by action of a pressure generator selected from the group consisting of (i) a pump, (ii) hydrostatic pressure due to gravity, and (iii) pressure generated by action of a siphon.

3. The waterbed mattress system according to claim 2 wherein, between the lower surface and the upper surface of the waterbed mattress, are situated internal structures comprised of (i) inner horizontal layers, (ii) longitudinal and transverse vertical layers, and (iii) small cells or compartments which have holes in the walls of the cells or compartments, which internal structures, when the angle of the force holding the waterbed mattress in place is changed, reduce in a time delaying manner, any movement due to dynamics of motion of the recreational vehicle, of any liquid remaining in the waterbed mattress after the waterbed mattress has been emptied, thereby preventing the liquid in the waterbed mattress from moving the emptied waterbed mattress from its location.

4. The waterbed mattress system according to claim 2 wherein the means for ingress or egress of the liquid to and into or out of the waterbed mattress, further includes a fibrous, soft, highly porous, flexible material inside of the waterbed mattress over a first tube attached to an aperture in the waterbed mattress which allows, by action of the pressure generator, exit flow of the liquid in the waterbed mattress without interference from collapse of the emptying waterbed mattress, through the first tube running from the aperture in the waterbed mattress to the pressure generator, from the pressure generator to the first valve, and from the first valve to the supply.

5. The waterbed mattress system for the recreational vehicle according to claim 2, wherein the means for ingress or egress of the liquid to and into or out of the waterbed mattress from the supply includes a first tube which runs both between the supply and a strainer and the strainer and a one-way first valve, and between the one-way first valve and the pressure generator, and includes a second tube which runs between the pressure generator and an aperture in the waterbed mattress.

6. The waterbed mattress system for the recreational vehicle according to claim 5, further comprising means for controlling at least one member of the following group consisting of (i) temperature, (ii) pressure and (iii) volume of the liquid being delivered to and into the waterbed mattress from the supply.

7. The waterbed mattress system for the recreational vehicle according to claim 6, which the means for controlling at least one member of the following group consisting of (i) temperature, (ii) pressure and (iii) volume of the liquid as the liquid ingresses or egresses the waterbed mattress, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into the waterbed mattress, (v) an overflow first tube running from an aperture in the waterbed mattress to the first valve to empty inside or outside of the recreational vehicle, and (vi) a pressure expansion tank, and which further includes a source of heat selected from the group consisting of (i) an engine, (ii) a generator engine, (iii) an auxiliary engine, (iv) a fuel, (v) a heat pump, (vi) a solar energy collector and (vii) electricity, an aqueous heat transfer liquid circulating system, a heat exchanger, a second tube running from the heat exchanger to the aperture in the water mattress, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the second valve, to the pressure generator, and from there on to the heat exchanger, a two-way third valve, and a fifth tube extending from the aperture in the waterbed mattress to the two-way third valve and from the two-way third valve to the heat exchanger.

8. The waterbed mattress system for the recreational vehicle according to claim 7 wherein the first valve is operated by an electronic control system through electromechanical operation of the first valve.

9. The waterbed mattress system for the recreational vehicle according to claim 7, wherein the temperature, pressure, volume and flow of the heat transfer liquid transported to, into, circulated to and removed from the waterbed mattress is operated automatically with an electronic control system through the electromechanical valves, pressure generators and regulators of the waterbed mattress system.

10. A waterbed mattress system comprising:

a. a wheeled recreational vehicle;

b. at least two waterbed mattresses, each large enough for a person to lay prone upon; and c. means for ingress or egress of a liquid, which is water or another aqueous liquid, to and into or out of each of the waterbed mattresses from a supply of the liquid selected from a group consisting of (i) a source external to the vehicle and (ii) a source internal to the vehicle.

11. The waterbed mattress system for the recreational vehicle according to claim 10, wherein the means for ingress or egress of the liquid to and into or out of each of the waterbed mattresses is by action of a pressure generator selected from the group consisting of (i) a pump, (ii) hydrostatic pressure due to gravity, and (iii) pressure generated by action of a siphon.

12. The waterbed mattress system according to claim 11, wherein, between the lower surface and the upper surface of each of the waterbed mattresses, are situated internal structures comprised of (i) inner horizontal layers, (ii) longitudinal and transverse vertical layers, and (iii) small cells or compartments which have holes in the walls of the cells or compartments, which internal structures, when the angle of the force holding the waterbed mattresses in place is changed, reduce in a time delaying manner, any movement due to dynamics of motion of the recreational vehicle, of any liquid remaining in the waterbed mattresses after the waterbed mattresses have been emptied, thereby preventing the liquid in the waterbed mattresses from moving the emptied waterbed mattresses from its location.

13. The waterbed mattress system according to claim 11 wherein the means for ingress or egress of the liquid to and into or out of the waterbed mattresses, further includes a fibrous, soft, highly porous, flexible material inside each of the waterbed mattresses over a first tube attached to an aperture in each of the waterbed mattresses which allows, by action of the pressure generator, exit flow of the liquid in each waterbed mattress without interference from collapse of the emptying waterbed mattress, through the first tube running from the aperture in the waterbed mattress to the pressure generator, from the pressure generator to the first valve, and from the first valve to the supply.

14. The waterbed mattress system for the recreational vehicle according to claim 11, wherein the means for ingress or egress of the liquid to and into or out of each of the waterbed mattresses from the supply includes a first tube which runs both between the supply and a strainer and the strainer and a one-way first valve, and between the one-way first valve and the pressure generator, and includes a second tube which runs between the pressure generator and an aperture in each of the waterbed mattresses.

15. The waterbed mattress system for the recreational vehicle according to claim 14 further comprising means for controlling at least one member of the following group consisting of (i) temperature, (ii) pressure and (iii) volume of the liquid being delivered to and into the waterbed mattresses from the supply.

16. The waterbed mattress system for the recreational vehicle according to claim 15, wherein the means for controlling at least one member of the following group consisting of (i) temperature, (ii) pressure and (iii) volume of the liquid as the liquid ingresses or egresses the waterbed mattresses, is selected from the group consisting of (i) a temperature regulator which has a temperature indicator means, (ii) a flow regulator, (iii) a flow limiting mechanism, (iv) an adjustable timer which regulates the length of time the flow regulator allows the liquid to be delivered to and into each of the waterbed mattresses, (v) an overflow first tube running from an aperture in each of the waterbed mattresses to the first valve to return to the supply, and (vi) a pressure expansion tank, and which further includes a source of heat selected from the group consisting of (i) an engine, (ii) a generator engine, (iii) an auxiliary engine, (iv) a fuel, (v) a heat pump, (vi) a solar energy collector and (vii) electricity, an aqueous heat transfer liquid circulating system, a heat exchanger, a second tube running from the heat exchanger to the aperture in each of the water mattresses, a third tube extending from the source of heat to a circulating first pump, from there to the heat exchanger, from there to the source of heat, from there on to a connection to the supply, from there on to the pressure generator, and from there on to a second valve, a fourth tube extending from the connection to the supply to the second valve, to the pressure generator, and from there on to the heat exchanger, a two-way third valve, and a fifth tube extending from the aperture in each of the waterbed mattresses to the two-way third valve and from the two-way third valve to the heat exchanger.

17. The waterbed mattress system for the recreational vehicle according to claim 16 wherein the first valve is operated by an electronic control system through electromechanical operation of the first valve.

18. The waterbed mattress system for the recreational vehicle according to claim 17 wherein the temperature, pressure, volume and flow of the heat transfer liquid transported to, into, circulated to and removed from the waterbed mattresses is operated automatically with an electronic control system through the electromechanical valves, pressure generators and regulators of the waterbed mattress system.

* * * * *